US012735796B2

(12) United States Patent
Kim et al.

(10) Patent No.: US 12,735,796 B2
(45) Date of Patent: Sep. 15, 2026

(54) MULTILAYER REINFORCED COMPOSITE ELECTROLYTE MEMBRANE AND METHOD FOR MANUFACTURING SAME

(71) Applicant: KOREA INSTITUTE OF SCIENCE AND TECHNOLOGY, Seoul (KR)

(72) Inventors: Jin Young Kim, Seoul (KR); Youngjoon Lim, Seoul (KR); Taehyun Kwon, Seoul (KR); Byeong-jo Min, Seoul (KR); Bora Seo, Seoul (KR); Hee-Young Park, Seoul (KR); So Young Lee, Seoul (KR); Hyun Seo Park, Seoul (KR); Sung Jong Yoo, Seoul (KR); Hyoung-Juhn Kim, Seoul (KR); Jong Hyun Jang, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 148 days.

(21) Appl. No.: 18/700,216

(22) PCT Filed: Sep. 15, 2022

(86) PCT No.: PCT/KR2022/013814
§ 371 (c)(1),
(2) Date: Apr. 10, 2024

(87) PCT Pub. No.: WO2023/096114
PCT Pub. Date: Jun. 1, 2023

(65) Prior Publication Data

US 2025/0019847 A1 Jan. 16, 2025

(30) Foreign Application Priority Data

Nov. 23, 2021 (KR) ..... 10-2021-0162317

(51) Int. Cl.
*C25B 13/08* (2006.01)
*C25B 13/02* (2006.01)

(52) U.S. Cl.
CPC ..... *C25B 13/08* (2013.01); *C25B 13/02* (2013.01)

(58) Field of Classification Search
CPC ..... C25B 13/02; C25B 13/08; C25B 9/23; H01M 8/1053; H01M 8/1004;
(Continued)

(56) References Cited

U.S. PATENT DOCUMENTS

2009/0186251 A1* 7/2009 Budinski ..... H01M 8/1004 429/414
2010/0291467 A1* 11/2010 Ji ..... B82Y 30/00 977/700
(Continued)

FOREIGN PATENT DOCUMENTS

JP 2006-73235 A 3/2006
JP 2018113123 A * 7/2018
(Continued)

OTHER PUBLICATIONS

Machine Translation of Jeong (KR102321252B1), Generated by Espacenet, 2021 (generated Oct. 31, 2025) (Year: 2021).*
(Continued)

*Primary Examiner* — Andrew L Swanson
(74) *Attorney, Agent, or Firm* — NSIP Law

(57) ABSTRACT

The present disclosure relates to a multilayer reinforced composite electrolyte membrane and a method for manufacturing the same. The multilayer reinforced composite electrolyte membrane according to the present disclosure has sufficient mechanical properties and improved membrane resistance at the same time since a porous support is impregnated in an ionomer and it is stacked in a multilayer
(Continued)

structure. Furthermore, since the composite electrolyte membrane has no wrinkles and cracks due to excellent dimensional stability, it can improve the electrochemical properties of batteries.

7 Claims, 4 Drawing Sheets

(58) Field of Classification Search
CPC ..... H01M 8/1067; H01M 8/1069; H01M 8/1081; H01M 2008/1095; H01M 8/1041; H01M 8/1058
See application file for complete search history.

(56) References Cited

U.S. PATENT DOCUMENTS

2018/0241061 A1* 8/2018 Kim ..... H01M 8/1081
2018/0290441 A1* 10/2018 Adachi ..... B32B 37/06
2018/0323441 A1* 11/2018 Nakanishi ..... H01M 4/8657
2020/0127315 A1* 4/2020 Moon ..... H01M 8/188
2021/0305612 A1* 9/2021 Oh ..... H01M 8/1004
2024/0128477 A1* 4/2024 Bartels ..... C25B 13/02

FOREIGN PATENT DOCUMENTS

KR 10-2001-0092802 A 10/2001
KR 10-2012-0128905 A 11/2012
KR 10-1754122 B1 7/2017
KR 10-2018-0076949 A 7/2018
KR 10-1995527 B1 7/2019
KR 10-2020-0033630 A 3/2020
KR 10-2089305 B1 5/2020
KR 102321252 B1 * 11/2021 ..... H01M 8/1067

OTHER PUBLICATIONS

Machine Translation of Nakazawa (JP2018113123), Generated by Espacenet, 2018 (Generated Oct. 31, 2025) (Year: 2018).*

* cited by examiner

【FIG. 2】
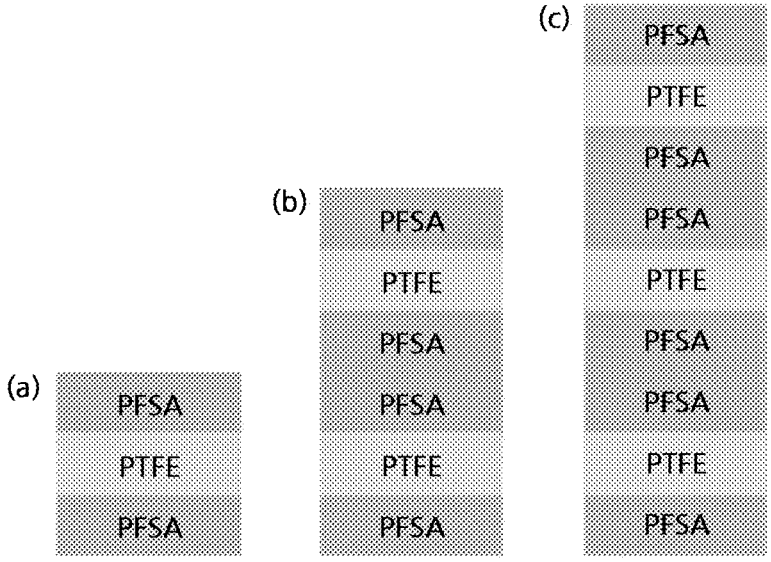
【FIG. 3】
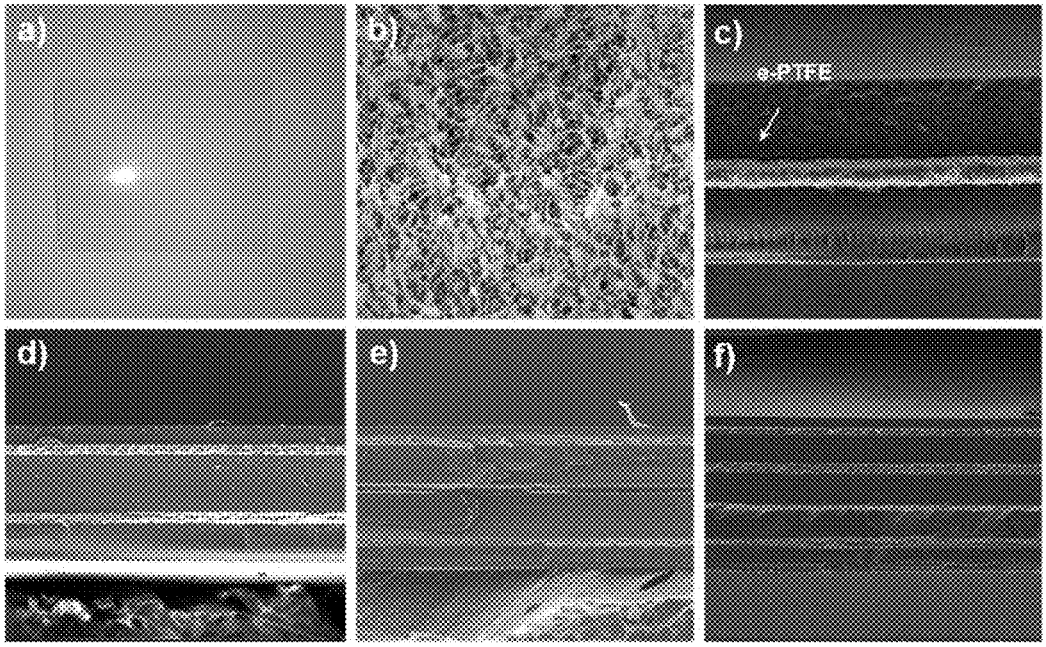

【FIG. 4】
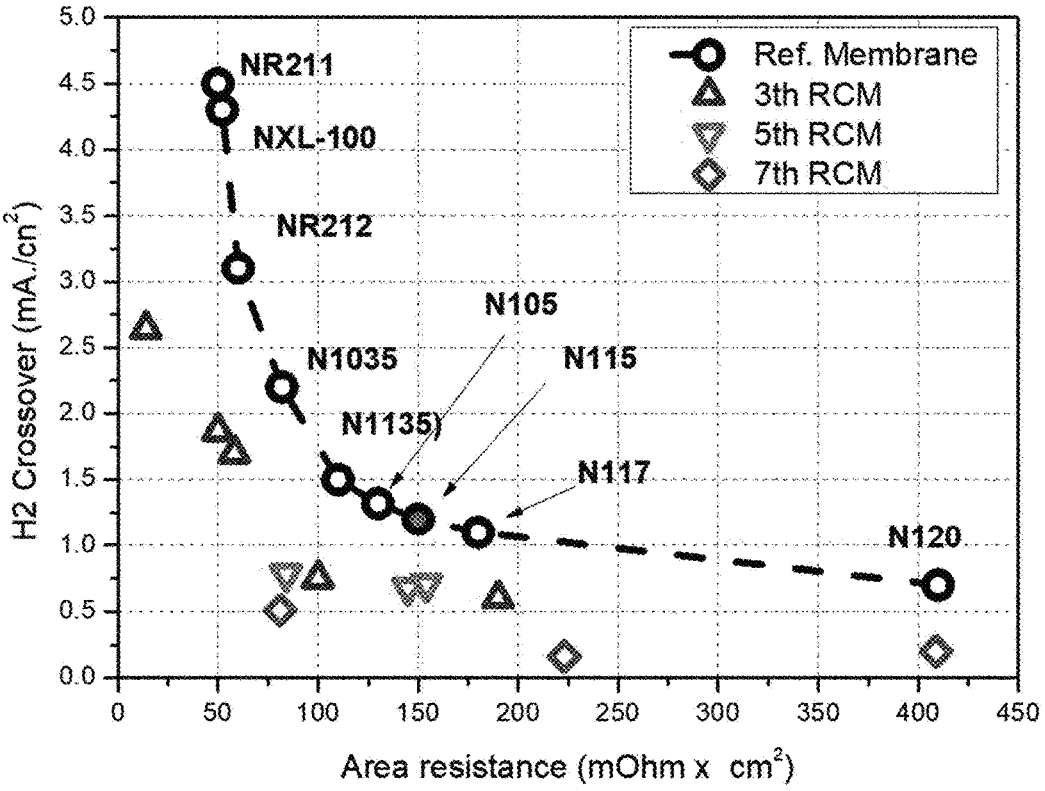

【FIG. 5】
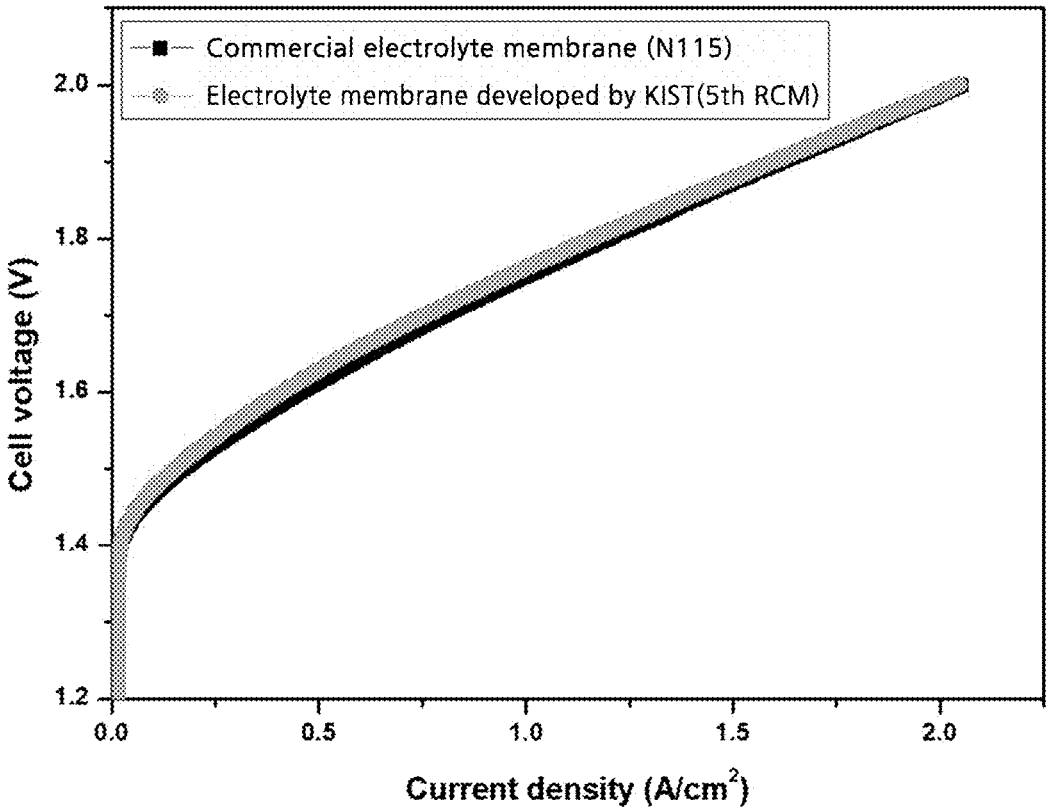

MULTILAYER REINFORCED COMPOSITE ELECTROLYTE MEMBRANE AND METHOD FOR MANUFACTURING SAME

CROSS REFERENCE TO RELATED APPLICATIONS

This application is a U.S. national stage application of International Application No. PCT/KR2022/013814 filed on Sep. 15, 2022, which claims the benefit of Korean Patent Application No. 10-2021-0162317 filed on Nov. 23, 2021, the entire disclosures of which are incorporated herein by reference for all purposes.

TECHNICAL FIELD

The present disclosure relates to a multilayer reinforced composite electrolyte membrane and a method for manufacturing the same.

BACKGROUND ART

With the launch of hydrogen fuel cell electric vehicles (FCEVs) using polymer electrolyte membrane fuel cells (PEMFCs) by automobile companies around the world in the 2020s, fuel cells for transportation entered the era of commercialization. However, in order for fuel cells for transportation to be utilized fully beyond simple commercialization, hydrogen used in the fuel cells must be produced and stored at low cost in an environmentally friendly manner. The conventional hydrogen production technology uses a method of obtaining hydrogen by reforming methane or ethane, and this process produces gray hydrogen that generates carbon dioxide.

Water electrolysis is a technology for obtaining hydrogen by electrolysis of water using the reverse reaction of a fuel cell. It can produce hydrogen in an environmentally friendly manner without emitting carbon dioxide. The types of water electrolysis are divided into alkaline water electrolysis, polymer electrolyte membrane (PEM) water electrolysis, solid oxide water electrolysis and anion exchange membrane (AEM) water electrolysis. Among them, the polymer electrolyte membrane water electrolysis is a technology for water electrolysis using polymer electrolyte membranes and exhibits the highest current density. It is currently in the developmental stage. For commercialization of the polymer electrolyte membrane water electrolysis, the durability of materials that can withstand the strong acidic environment of the water electrolysis itself is important.

As the electrolyte membrane used in the polymer electrolyte membrane water electrolysis, Nafion produced by DuPont is mainly used as a fluorocarbon-based electrolyte membrane. In the polymer electrolyte membrane water electrolysis, a membrane with a thickness of 100 μm or larger is used to prevent the penetration of hydrogen gas. However, as the thickness of the membrane increases, membrane resistance increases, electrochemical performance decreases, and hydrogen production capacity decreases. In order to solve this dilemma, various research institutes around the world have carried out researches to improve the mechanical properties of electrolyte membranes and reduce hydrogen gas permeability by introducing various types of frameworks.

Korean Patent Registration No. 10-1995527 proposed a reinforced composite membrane for fuel cells that can exhibit improved hydrogen ion conductivity by increasing uniformity and impregnation rate by impregnating ionic conductors. The reinforced composite membrane can exhibit improved hydrogen ion conductivity since an ionic conductor (sulfonated hydrocarbon-based polymer) is mixed with a polymer for forming a porous support and electrospun to increase the affinity of the porous support with an organic solvent and the ion conductor, making the ionic conductor easy to be impregnated and increasing the impregnation uniformity and impregnation rate of the ionic conductor. However, since the manufacturing method uses a sulfonated hydrocarbon-based polymer and uses the electrospinning technique, it is difficult to prepare a membrane with a large area and there is a problem that protons are decreased. It also has the limitation that it is simply used only for fuel cell separation membranes.

In Korean Patent Registration No. 10-2089305, a separation membrane with a thickness of 600 μm was prepared by dissolving a porous zirconia ceramic fabric, casting the same to a thickness of 200 μm and then additionally adding a solvent. The thickness of the finally prepared water electrolysis separation membrane was 430 (±50) μm. The hydrolytic separation membrane showed high conductivity, low hydrogen permeability and high wettability to KOH, and showed high physical strength even with a small thickness. However, since this processing method requires the preparation of a thick electrolyte membrane with a thickness of 430 μm, current density decreases and it is difficult to achieve large area and reproducibility.

In Korean Patent Registration No. 10-1754122, in order to minimize expansion rate in the x-y axes, a reinforced composite membrane for water electrolysis with decreased oxygen penetration into a hydrogen electrode and ensured dimensional stability was prepared by placing a unidimensionally woven reinforcing support layer inside and forming a reinforcing layer by performing electrospinning three-dimensionally for both axes to minimize expansion rate in the z-axis. However, when a reinforcing support layer is prepared by weaving, it is difficult to achieve a large area and there is a problem that protons decrease.

Carolin Klose from Germany created a single cell for water electrolysis by preparing a separation membrane by sulfonating a polyphenylene polymer and then drying the same and optimizing the prepared separation membrane for a membrane-electrode assembly (MEA) process. As a result, although high current density and low hydrogen permeability were achieved, there was no technical difference in that the separation membrane was prepared through simple sulfonation of a hydrocarbon used in existing fuel cell separation membranes. In addition, there was a problem that durability could be decreased since the separation membrane was prepared by spraying a solution and then drying the same.

Stefania Siracusano from Italy prepared a separation membrane for water electrolysis by hot-pressing a Nafion separation membrane. Whereas the existing commercial N115 membrane was prepared through an extrusion process, the separation membrane was prepared by changing the process to hot pressing. In this case, there was no significant difference from the extrusion process and there is a limitation that it is not an appropriate method for mass production because a larger amount of polymer separation membranes can be prepared by the extrusion process.

Peter Holzapfel from Germany prepared a membrane-electrode assembly by preparing a Nafion D2021 ionomer into a solution state and then spraying it directly onto an electrode. However, since the separation membrane solution is sprayed directly onto the electrode, the size of the separation membrane cannot be uniform and the solvent for the separation membrane affects the electrode and current density performance. Also, there was a limitation that the dispersibility of the separation membrane solution may decrease during coating.

Therefore, since the electrolyte membrane for water electrolysis is not limited to being simply prepared by solution casting or autospray method but hydrogen gas permeability can be reduced while improving current density, the development of a technology for an electrolyte membrane whose durability does not deteriorate over time is necessary.

REFERENCES OF RELATED ART

Patent Documents (Patent document 1) Korean Patent Registration No. 10-1995527.

(Patent document 2) Korean Patent Registration No. 10-1754122.

(Patent document 3) Korean Patent Registration No. 10-2089305.

DISCLOSURE

Technical Problem

The present disclosure is directed to providing a multilayer reinforced composite electrolyte membrane having a reduced thickness as it includes a multilayered porous support wherein a thin ionomer layer is formed, exhibiting improved ionic conductivity and durability and exhibiting excellent dimensional stability as a stable interface is formed between the ionomer and the porous support.

Technical Solution

In an aspect, the present disclosure provides a multilayer reinforced composite electrolyte membrane wherein one or more reinforced composite electrolyte membrane layers including: a porous support impregnated with an ionomer; and an ionomer layer formed on both sides of the porous support are stacked, wherein the ionomer layer has a thickness of 1-25 μm.

In another aspect, the present disclosure provides a water electrolysis device including the multilayer reinforced composite electrolyte membrane.

In another aspect, the present disclosure provides a fuel cell including the multilayer reinforced composite electrolyte membrane.

In another aspect, the present disclosure provides a method for manufacturing a multilayer reinforced composite electrolyte membrane, which includes: (a) a step of preparing an ionomer solution containing 17-40 wt % of an ionomer; (b) a step of preparing a reinforced composite electrolyte membrane wherein an ionomer layer with a thickness of 1-25 μm is formed on both sides of a porous support by impregnating the porous support in the ionomer solution and then drying the same; and (c) a step of stacking one or more of the reinforced composite electrolyte membrane and manufacturing a multilayer reinforced composite electrolyte membrane by applying heat and pressure.

Advantageous Effects

A multilayer reinforced composite electrolyte membrane according to an exemplary embodiment of the present disclosure has sufficient mechanical properties and improved membrane resistance because a porous support is impregnated with an ionomer and the membrane is stacked in a multilayer structure. Furthermore, the electrochemical properties of a battery can be improved due to excellent dimensional stability.

BRIEF DESCRIPTION OF DRAWINGS

FIG. 2 is a schematic diagram showing multilayer reinforced composite electrolyte membranes manufactured in (a) Example 1, (b) Example 2 and (c) Example 3 of the present disclosure.

FIG. 3 shows the actual image of a multilayer reinforced composite electrolyte membrane manufactured in Example 1 of the present disclosure (a), the scanning electron microscopic (SEM) image of porous polytetrafluoroethylene (PTFE) used as a porous support in the present disclosure (b) and the scanning electron microscopic (SEM) images of multilayer reinforced composite electrolyte membranes prepared in Example 1 (c), Example 2 (d), Example 3 (e), and Example 4 (f) of the present disclosure.

FIG. 4 shows the hydrogen gas permeability compared to membrane resistance of a multilayer reinforced composite electrolyte membrane prepared in Example 1 of the present disclosure and a polymer electrolyte membrane prepared in Comparative Example 1.

FIG. 5 shows the current-voltage curves of water electrolysis cells using a multilayer reinforced composite electrolyte membrane prepared in Example 2 of the present disclosure and a polymer electrolyte membrane prepared in Comparative Example 1.

BEST MODE

Figure 1:
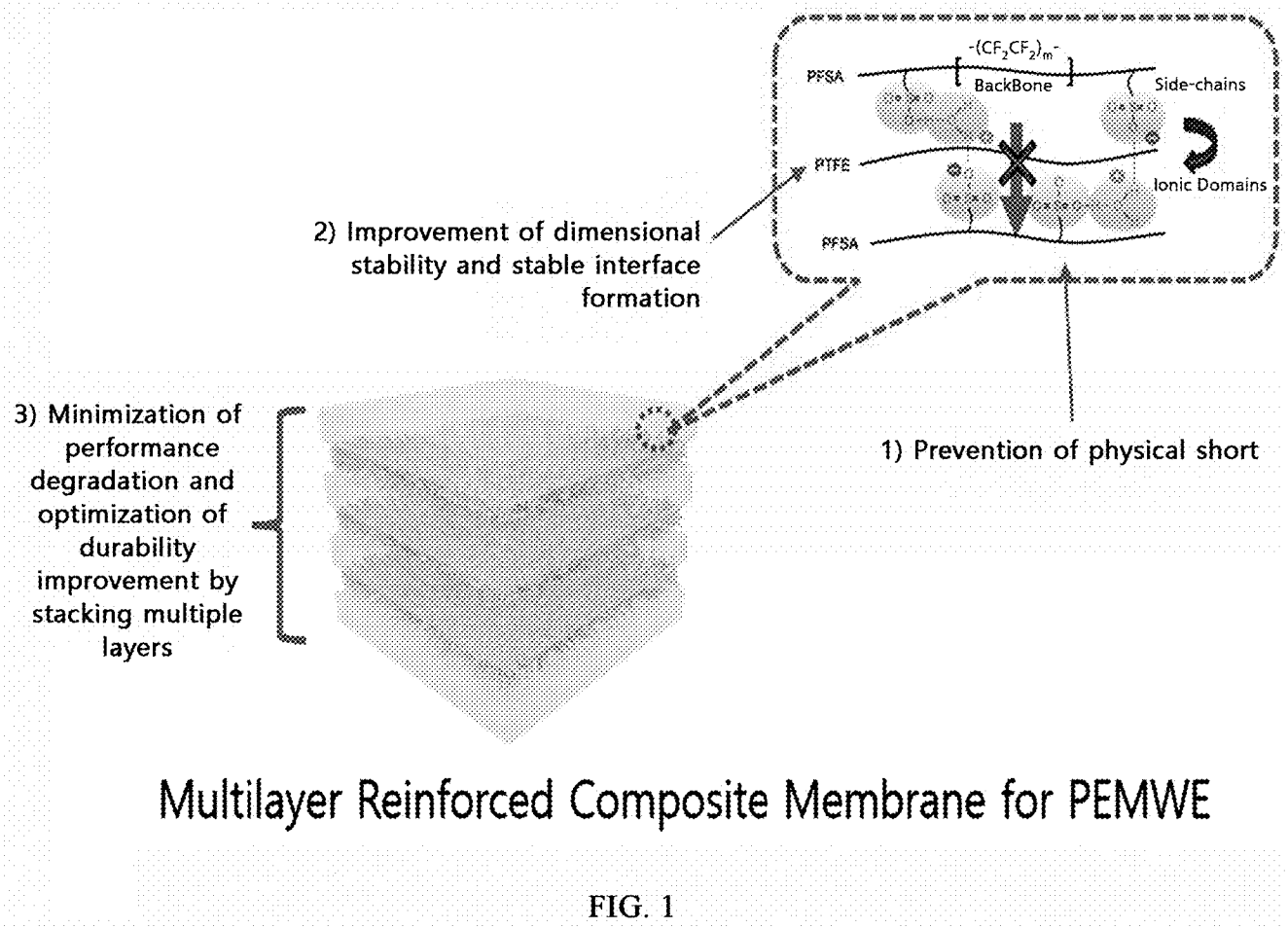
FIG. 1 shows a schematic diagram of a multilayer reinforced composite electrolyte membrane according to the present disclosure.

Hereafter, the present disclosure will be explained in detail along with the attached drawings and preferred embodiments of the present disclosure.

The present disclosure provides a multilayer reinforced composite electrolyte membrane wherein one or more reinforced composite electrolyte membrane layers including: a porous support impregnated with an ionomer; and an ionomer layer formed on both sides of the porous support are stacked, wherein the ionomer layer has a thickness of 1-25 μm.

FIG. 1 shows a schematic diagram of the multilayer reinforced composite electrolyte membrane according to the present disclosure. Referring to the figure, the multilayer reinforced composite electrolyte membrane according to the present disclosure can show excellent dimensional stability by forming a stable interface between the ionomer and the porous support, and can reduce thickness and improve durability at the same time since it includes the porous support impregnated with the ionomer of a thin thickness with a multilayer structure. Also, since the increase in membrane resistance due to the increase in thickness can be improved significantly, improved ionic conductivity can be achieved.

The ionomer layer can be located on both sides of the porous support, and the thickness of the ionomer layer can be 1-25 μm, specifically 2-23 μm, more specifically 4-20 μm, most specifically 5-15 μm. If the thickness of the ionomer layer is smaller than 1 μm, delamination may occur between the reinforced composite electrolyte membranes stacked in multiple layers. And, if it exceeds 25 μm, membrane resistance may increase significantly due to the excessive thickness.

The reinforced composite electrolyte membrane may be prepared by impregnating the porous support in an ionomer solution containing 17-40 wt %, more specifically 20-30 wt %, most specifically 22-27 wt %, of an ionomer. If the porous support is impregnated in an ionomer solution containing less than 17 wt % of the ionomer, it may be difficult to control the thickness of the ionomer layer, and the ionomer layer cannot be formed sufficiently. As a result, ionic conductivity can be decreased significantly. On the other hand, if the ionomer is impregnated in an ionomer solution containing more than 40 wt % of the ionomer, the ionomer may not be impregnated smoothly into the porous support, or resistance may increase significantly due to aggregation of the ionomer.

The multilayer reinforced composite electrolyte membrane may be one in which the reinforced composite electrolyte membrane is stacked in 1-9 layers, specifically 2-7 layers, most specifically 2 layers. If the reinforced composite electrolyte membrane is not composed of the porous support and the ionomer layer formed on both sides of the porous support, hydrogen gas permeability may increase. And, if more than 9 layers are stacked, resistance may increase and ionic conductivity may decrease rapidly due to excessive thickness of the membrane. In particular, it is most desirable that the reinforced composite electrolyte membrane is stacked in 2 layers because low hydrogen gas permeability can be achieved without decrease in ionic conductivity.

The ionomer may be one or more selected from a group consisting of Nafion, Flemion, Aquivion, 3M™ PFSA ionomers and Aciplex.

The porous support may include multiple pores and can include one or more selected from a group consisting of polytetrafluoroethylene (PTFE), polyether ether ketone (PEEK), polyimide (PI), polyethylene (PE), polyethylene terephthalate (PET), polyether sulfone (PES), polyarylene ether sulfone (PAES) and poly(styrene-ethylene-butylene-styrene) (SEBS).

The pore diameter of the porous support can be 100-900 nm, specifically 200-800 nm, more specifically 300-700 nm. If the pore diameter of the porous support is below the lower limit, ionic conductivity may be decrease significantly because the ionomer is not impregnated sufficiently. And, if it exceeds the upper limit, improvement of mechanical strength cannot be expected due to excessive impregnation of the ionomer.

The ionomer may be a perfluorosulfonic acid (PFSA) ionomer, and the porous support may be polytetrafluoroethylene (PTFE). The perfluorosulfonic acid ionomer and the polytetrafluoroethylene have the advantage that hydrogen gas permeability can be decreased due to superior bonding strength and interfacial stability.

The thickness of the multilayer reinforced composite electrolyte membrane may be 27-95 μm, specifically 30-92 μm, more specifically 35-85 μm, most specifically 40-75 μm. If the thickness of the multilayer reinforced composite electrolyte membrane is smaller than 27 μm, mechanical strength can decrease rapidly. And, if the thickness of the multilayer reinforced composite electrolyte membrane exceeds 95 μm, ionic conductivity may decrease significantly due to increased membrane resistance.

The Young's modulus of the multilayer reinforced composite electrolyte membrane may be 250-400 MPa, specifically 270-380 MPa, more specifically 280-360 MPa, most specifically 300-320 MPa. If the Young's modulus of the multilayer reinforced composite electrolyte membrane is lower than 250 MPa, mechanical strength may decrease significantly. And, if it exceeds 400 MPa, interlayer peeling of the multilayer reinforced composite electrolyte membrane may occur or the membrane may be prone to breakage.

The dimensional change rate of the multilayer reinforced composite electrolyte membrane defined by Equation 1 may be 0.1-6%, specifically 0.3-5.5%, more specifically 0.7-5%, most specifically 1-4.5%. It was confirmed that, when the dimensional change rate of the multilayer reinforced composite electrolyte membrane satisfies the above range, the dimensions of the polymer electrolyte membrane do not change rapidly even after containing water and, therefore, displacement, wrinkling and deformation do not occur.

$$\text{Dimensional change rate (\%)} = \frac{A_{wet} - A_{dry}}{A_{dry}} \quad \text{[Equation 1]}$$

Dimensional Change Rate

In Equation 1, $A_{wet}$ means the area of the electrolyte membrane after being impregnated in ultrapure water for 24 hours at 25° C., and $A_{dry}$ means the area of the electrolyte membrane in a dry state.

Furthermore, the present disclosure provides a water electrolysis device including the multilayer reinforced composite electrolyte membrane.

Furthermore, the present disclosure provides a fuel cell including the multilayer reinforced composite electrolyte membrane.

In addition, the present disclosure provides a method for manufacturing a multilayer reinforced composite electrolyte membrane, which includes: (a) a step of preparing an ionomer solution containing 17-40 wt % of an ionomer; (b) a step of preparing a reinforced composite electrolyte membrane wherein an ionomer layer with a thickness of 1-25 μm is formed on both sides of a porous support by impregnating the porous support in the ionomer solution and then drying the same; and (c) a step of stacking one or more of the reinforced composite electrolyte membrane and manufacturing a multilayer reinforced composite electrolyte membrane by applying heat and pressure.

According to the method for manufacturing a multilayer reinforced composite electrolyte membrane of the present disclosure, a reinforced composite electrolyte membrane can be prepared using an ionomer coating method capable of simultaneously forming ionomer layers with predetermined thicknesses on both sides of a porous support, and a multilayer reinforced composite electrolyte membrane is manufactured by stacking and compressing the reinforced composite electrolyte membrane.

The thickness of the ionomer layer may be 1-25 μm, specifically 2-23 μm, more specifically 4-20 μm, most specifically 5-15 μm.

The ionomer may be contained in an amount of 17-40 wt %, more specifically 20-30 wt %, most specifically 22-27 wt %, based on 100 wt % of the ionomer solution.

The ionomer solution contains the ionomer and a solvent. Specifically, the solvent may be one or more selected from a group consisting of water, ethanol, 1-propanol, dimethylacetamide, isopropanol, dimethylformamide and dimethyl sulfoxide, although not being limited thereto.

The multilayer reinforced composite electrolyte membrane may be one in which the reinforced composite electrolyte membrane is stacked in 1-9 layers, specifically 2-7 layers, most specifically 2 layers.

The ionomer may be a perfluorosulfonic acid (PFSA) ionomer, and the porous support may be polytetrafluoroethylene (PTFE).

The thickness of the multilayer reinforced composite electrolyte membrane may be 27-95 μm, specifically 30-92 μm, more specifically is 35-85 μm, most specifically 40-75 μm.

The Young's modulus of the multilayer reinforced composite electrolyte membrane may be 250-400 MPa, specifically 270-380 MPa, more specifically 280-360 MPa, most specifically 300-320 MPa.

The multilayer reinforced composite electrolyte membrane may have a dimensional change rate of 0.1-6%, specifically 0.3-5.5%, more specifically 0.7-5%, most specifically 1-4.5%, as defined by Equation 1.

$$\text{Dimensional change rate (\%)} = \frac{A_{wet} - A_{dry}}{A_{dry}} \quad \text{[Equation 1]}$$

Dimensional Change Rate

In Equation 1, $A_{wet}$ means the area of the electrolyte membrane after being impregnated in ultrapure water for 24 hours at 25° C., and $A_{dry}$ means the area of the electrolyte membrane in a dry state.

The impregnation in the step (b) may be performed using any one selected from a group consisting of a bar coater, a roll coater and a spray coater, most specifically using a bar coater.

The drying in the step (b) may be performed at 30-120° C., specifically 40-100° C., more specifically 50-90° C., most specifically 60-80° C., for 2-10 hours, specifically 3-9 hours, more specifically 4-8 hours, most specifically 5-7 hours.

Prior to the step (c), a step of stacking at least one of the reinforced composite electrolyte membrane and applying pressure may be further included. The applied pressure may be 100-800 psi, specifically 300-600 psi, and may be performed using any one selected from a group consisting of a roll press, a pressing jig and a plate press.

The step (c) may be performed using any one selected from a group consisting of a roll press, a pressing jig and a plate press.

The pressure applied to the reinforced composite electrolyte membrane stacked in the step (c) may be 1000-2000 psi, specifically 1300-1800 psi. If the pressure applied to the reinforced composite electrolyte membrane stacked in one or more layer is lower than 1000 psi, separation may occur because the bonding between the stacked reinforced composite electrolyte membranes is insufficient. And, if it exceeds 2000 psi, wrinkling and cracking may occur due as the membrane is pushed during the pressurization process of the stacked reinforced composite electrolyte membrane.

The temperature applied to the reinforced composite electrolyte membrane stacked in one or more layer in the step (c) may be 110-170° C., specifically 120-150° C., more specifically 130-140° C., most specifically 132-138° C. If the temperature applied to the reinforced composite electrolyte membrane stacked in one or more layer is lower than 110° C., the reinforced composite electrolyte membranes may not be bonded to each other and may be separated due to increased interfacial resistance. And, if it exceeds 170° C., the reinforced composite electrolyte membrane may be damaged or deformed.

In particular, although not explicitly described in the following examples and comparative examples, in the process for manufacturing a multilayer reinforced composite electrolyte membrane according to the present disclosure, a multilayer reinforced composite electrolyte membrane was manufactured using the following conditions, a water electrolysis reaction was performed for 300 cycles on a cell using the same, and the surface was observed using a scanning electron microscope.

Surprisingly, there were no wrinkling, deformation or cracking in the multilayer reinforced composite electrolyte membrane due to superior dimensional stability and mechanical properties even after 300 cycles of the water electrolysis reaction and the current density of the electrolysis cell remained constant when all of the following conditions were satisfied.

1) The ionomer solution contains 22-27 wt % of the ionomer,
2) The thickness of the ionomer layer formed on both sides of the porous support is 5-15 μm,
3) The multilayer reinforced composite electrolyte membrane consists of 2 layers of the stacked reinforced composite electrolyte membrane,
4) The ionomer is a perfluorosulfonic acid (PFSA) ionomer, and the porous support is polytetrafluoroethylene (PTFE),
5) The thickness of the multilayer reinforced composite electrolyte membrane is 40-75 μm,
6) The Young's modulus of the multilayer reinforced composite electrolyte membrane is 300-320 MPa,
7) The multilayer reinforced composite electrolyte membrane has a dimensional change rate of 1-4.5% as defined by Equation 1, $$\text{Dimensional change rate (\%)} = \frac{A_{wet} - A_{dry}}{A_{dry}} \quad \text{[Equation 1]}$$

Dimensional Change Rate (In Equation 1, $A_{wet}$ means the area of the electrolyte membrane after being impregnated in ultrapure water for 24 hours at 25° C., and $A_{dry}$ means the area of the electrolyte membrane in a dry state.)

8) A step of stacking at least one of the reinforced composite electrolyte membrane and applying pressure of 300-600 psi using a roll press is further included prior to the step (c), and
9) In the step (c), the pressure applied to the reinforced composite electrolyte membrane stacked in one or more layer is 1300-1800 psi, and the temperature is 132-138° C.

However, if any of the above conditions was not satisfied, the current density of the cell decreased significantly compared to the beginning after 200 cycles of the water electrolysis reaction, and deformation and wrinkling of the multilayer reinforced composite electrolyte membrane occurred or interlayer peeling with the electrode was observed after 300 cycles of the water electrolysis reaction.

Hereafter, the present disclosure is explained in more detail using examples. However, these examples are provided only for illustrative purposes to help understand the present disclosure, and the category and scope of the present disclosure are not limited by the following examples. Since the present disclosure can be changed variously and can have various forms, the examples are not intended to limit the present disclosure to a specific form, and should be understood to include all changes, equivalents and substitutes included within the idea and technical scope of the present disclosure.

Example 1

Preparation of Reinforced Composite Electrolyte Membrane

A PFSA solution containing 25 wt % of a perfluorosulfonic acid (PFSA) ionomer was prepared by adding 7 mL of distilled water, 8.72 mL of 1-propanol and 1 ml of ethanol, as a solvent, to 6 g of a perfluorosulfonic acid ionomer powder and then sufficiently dispersing with a stirrer at room temperature for 6 hours.

A reinforced composite electrolyte membrane was prepared by a modified roll-to-roll process. After fixing a release film by setting a bar coater to vacuum, a porous Teflon (polytetrafluoroethylene, PTFE) film with a thickness of 5 μm and an average pore size of 0.67 μm was fixed using a tape. The temperature and speed of the bar coater were then adjusted to 40° C. and 10 mm/sec, respectively, and the previously prepared PFSA solution was impregnated above and below the porous Teflon film using a micrometer film applicator. The porous Teflon impregnated with PFSA was dried in an oven at 70° C. for 6 hours and then separated slowly from the release film to prepare a PFSA/PTFE reinforced composite electrolyte membrane. The thickness of the PFSA layer formed on one side of the reinforced composite electrolyte membrane was 15±2 μm, and each layer of PFSA showed a tendency to decrease by about 1-2 μm as the ionomer layers changed into a multilayer structure through the pressurization process.

Preparation of Multilayer Reinforced Composite Electrolyte Membrane

The PFSA/PTFE reinforced composite electrolyte membrane prepared above was processed to a predetermined size and bonded by applying a pressure of 500 psi through a roll press process. Next, after placing the pressurized multilayer reinforced composite electrolyte membrane between metal plates, heat of 135° C. and pressure of 1500 psi were applied for 40 minutes, and then separated from the metal plates to prepare a one-layer reinforced composite electrolyte membrane. The prepared multilayer reinforced composite electrolyte membrane was stored in vacuum until use. FIG. 2 is a schematic diagram showing the multilayer reinforced composite electrolyte membranes manufactured in Examples 1-3.

Example 2

A two-layer reinforced composite electrolyte membrane was prepared in the same way as in Example 1, except that two processed PFSA/PTFE reinforced composite electrolyte membranes were stacked instead of one.

Example 3

A three-layer reinforced composite electrolyte membrane was prepared in the same way as in Example 1, except that three processed PFSA/PTFE reinforced composite electrolyte membranes were stacked instead of one.

Example 4

A four-layer reinforced composite electrolyte membrane was prepared in the same way as in Example 1, except that four processed PFSA/PTFE reinforced composite electrolyte membranes were stacked instead of one.

Comparative Example 1

A commercially available DuPont's polymer electrolyte membrane N115 was used.

Test Example 1. Scanning Electron Microscopy Analysis

The multilayer reinforced composite electrolyte membranes prepared in Examples 1-3 were treated with liquid nitrogen and the cross-sectional state and thickness were measured with a scanning electron microscope (INSPECT F50, FEI Company, USA). The result is shown in FIG. 3 and Table 1.

FIG. 3 shows the actual image of the multilayer reinforced composite electrolyte membrane manufactured in Example 1 of the present disclosure (a), the scanning electron microscopic (SEM) image of the porous polytetrafluoroethylene (PTFE) used as a porous support in the present disclosure (b) and the scanning electron microscopic (SEM) images of the multilayer reinforced composite electrolyte membranes prepared in Example 1 (c), Example 2 (d), Example 3 (e), and Example 4 (f) of the present disclosure.

Referring to FIG. 3, it can be seen that the multilayer reinforced composite electrolyte membrane according to the present disclosure shows a structure in which the porous support impregnated with the ionomer is stacked.

Test Example 2. Analysis of Physical Properties

The thickness, dry Nafion density and dimensional change rate of the multilayer reinforced composite electrolyte membranes prepared in Examples 1-3 and the polymer electrolyte membrane of Comparative Example 1 were measured and shown in Table 1 below.

TABLE 1

| | Thickness (μm) | Dry Nafion density ($mg/cm^3$) | Dimensional change rate (%) |
|---|---|---|---|
| Comparative Example 1 | 127 | 1.77 | 14.12 |
| Example 1 | 32 ± 4 | 1.54 | 4.53 |
| Example 2 | 60 ± 5 | 1.61 | 3.37 |
| Example 3 | 91 ± 5 | 1.57 | 1.34 |

The multilayer reinforced composite electrolyte membranes prepared in Examples 1-3 were cut to 10×40 $mm^2$, dried in an oven at 70° C. for 6 hours and then thickness and weight were measured using a micrometer. Then, the dry Nafion density was calculated from the difference from the weight of the polytetrafluoroethylene (PTFE) used in the examples.

Also, the dimensional change rate (%) of the multilayer reinforced composite electrolyte membranes prepared in Examples 1-3 and the polymer electrolyte membrane of Comparative Example 1 were calculated using Equation 1 after soaking them in ultrapure water at 25° C. for 24 hours and then measuring the area change of the electrolyte membranes before and after the impregnation.

$$\text{Dimensional change rate (\%)} = \frac{A_{wet} - A_{dry}}{A_{dry}} \quad \text{[Equation 1]}$$

Dimensional Change Rate

In Equation 1, $A_{wet}$ means the area of the electrolyte membrane after being impregnated in ultrapure water for 24 hours at 25° C., and $A_{dry}$ means the area of the electrolyte membrane in a dry state.

Referring to Table 1, the multilayer reinforced composite electrolyte membranes prepared in Examples 1-3 had smaller thicknesses than the commercial membrane N115 of Comparative Example 1. Through this, it was confirmed that the multilayer reinforced composite electrolyte membrane according to the present disclosure can be prepared with a smaller thickness than the conventional electrolyte membrane. Also, it can be seen from Examples 1-3 that the amount of the perfluorosulfonic acid (PFSA) ionomer is decreased due to the introduction of polytetrafluoroethylene (PTFE). Also, it can be seen from Examples 1-3 that the dimensional change rate decreases significantly as the number of stacked reinforced composite electrolyte membranes increases.

In order to measure the tensile strength of the multilayer reinforced composite electrolyte membranes prepared in Examples 1-3 and the polymer electrolyte membrane of Comparative Example 1, the electrolyte membrane with a rectangular shape (10 mm wide, 40 mm long) was fixed to a tensile tester, and then the Young's modulus and elongation rate were measured while applying force at a rate of 10 mm/min at room temperature. The result is shown in Table 2.

TABLE 2

| | Young's modulus (MPa) | Stress at break (MPa) | Elongation (%) |
|---|---|---|---|
| Comparative Example 1 | 230 | 50 | 269 |
| Example 1 | 349 | 41 | 64 |
| Example 2 | 308 | 51 | 62 |
| Example 3 | 318 | 60 | 88 |

Referring to Table 2, it can be seen that the Young's modulus of the multilayer reinforced composite electrolyte membranes prepared in Examples 1-3 is about 300 MPa, which is higher than 230 MPa of the existing commercial membrane. It is thought that, since the porous support polytetrafluoroethylene (PTFE) has superior mechanical properties and high crystallinity, the mechanical properties and crystallinity of the prepared multilayer reinforced composite electrolyte membrane are improves significantly as compared to the commercial membrane N115 of Comparative Example 1.

Test Example 3. Analysis of Electrochemical Characteristics of Fuel Cell

A single cell test was performed to analyze the electrochemical properties of the multilayer reinforced composite electrolyte membranes prepared in Examples 1-3 and the polymer electrolyte membrane of Comparative Example 1 in a fuel cell environment. First, 46.6 wt % of commercial platinum-supported carbon (Pt/C), 5 wt % of Nafion resin solution (Sigma Aldrich, USA) and isopropanol (Honeywell, Germany) were mixed and then dispersed in an ultrasonic disperser for 30 minutes to prepare a catalyst slurry. The dispersed catalyst slurry was then applied on the multilayer reinforced composite electrolyte membranes prepared in Examples 1-3 and the polymer electrolyte membrane of Comparative Example 1, so that the amount of platinum (Pt) was 0.2 mg/cm$^2$ (fuel electrode) and 0.4 mg/cm$^2$ (air electrode), respectively, and 39BC (SGL, Germany) was used as a gas diffusion layer (GDL) to prepare a membrane-electrode assembly. The prepared membrane-electrode assembly was connected to a station (C&L, Korea). The membrane-electrode assembly was then activated for 2-4 hours by setting temperature and flow rate to 80° C., 0.2 L/min (fuel electrode, hydrogen gas) and 0.6 L/min (air electrode, air), and a current-voltage curve (I-V curve) was obtained by performing electrochemical impedance spectroscopy (EIS) at 100% RH (relative humidity). Next, after adjusting the air electrode with nitrogen, when the open circuit voltage (OCV) was decreased, the hydrogen gas permeability of the electrolyte membrane was measured by linear sweep voltammetry (LSV). The result is shown in FIG. 4.

FIG. 4 shows the hydrogen gas permeability versus membrane resistance of the multilayer reinforced composite electrolyte membrane prepared in Example 1 of the present disclosure and the polymer electrolyte membrane prepared in Comparative Example 1. Referring to the figure, it can be seen that the multilayer reinforced composite electrolyte membranes prepared in Examples 1-3 show lower membrane resistance than the electrolyte membrane of Comparative Example 1. It can be seen that lower hydrogen gas permeability can be achieved as more reinforced composite electrolyte membranes are stacked.

Test Example 4. Analysis of Electrochemical Characteristics of Water Electrolysis Cell A single cell test was performed to measure the electrochemical properties of water electrolysis cells using the multilayer reinforced composite electrolyte membrane prepared in Example 2 and the polymer electrolyte membrane of Comparative Example 1. First, an oxidation electrode slurry composition was prepared by mixing 85.7 wt % of commercial iridium oxide, 5 wt % of Nafion resin solution and isopropanol, and a reduction electrode slurry composition was prepared by mixing 46.6 wt % of commercial platinum-supported carbon (Pt/C), 5 wt % of Nafion resin solution and isopropanol. The catalyst slurry prepared above was then applied to the multilayer reinforced composite electrolyte membrane prepared in Example 2 and the polymer electrolyte membrane of Comparative Example 1 using an auto spray device to 0.8 mg/cm$^2$ (reduction electrode) and 1.0 mg/cm$^2$ (oxidation electrode). Thereafter, a membrane-electrode assembly was prepared using Ti paper mesh (Bekaert Toko Metal Fiber, Japan) and 39BC (SGL, Germany) as gas diffusion layers (GDLs). The prepared membrane-electrode assembly was connected to a station (C&L, Korea), and a current-voltage curve was obtained by adjusting the temperature and flow rate of the membrane-electrode assembly to 80° C. and 15 mL/min. The result is shown in FIG. 5.

FIG. 5 shows the current-voltage curves of the water electrolysis cells using the multilayer reinforced composite electrolyte membrane prepared in Example 2 of the present disclosure and the polymer electrolyte membrane prepared in Comparative Example 1. Referring to the figure, it can be seen that the multilayer reinforced composite electrolyte membrane prepared in Example 2 shows performance comparable to that of the commercial membrane even in the water electrolysis environment despite having a lower dry Nafion density (Table 1) than Comparative Example 1.

The invention claimed is:

1. A method for manufacturing a multilayer reinforced composite electrolyte membrane, comprising:

(a) a step of preparing an ionomer solution comprising 22-27 wt % of an ionomer;

(b) a step of preparing a reinforced composite electrolyte membrane wherein two ionomer layers with a thickness of 5-15 μm are formed in contact with both sides of a porous support, respectively, by impregnating the porous support in the ionomer solution and then drying the same;

(c) a step of stacking two or more of the reinforced composite electrolyte membranes and applying a pressure of 300-600 psi using a roll press to the two or more of the reinforced composite electrolyte membranes without applying heat; and (d) a step of applying heat and pressure of 1300-1800 psi at a temperature of 132-138° C. to the two or more of the reinforced composite electrolyte membranes to obtain the multilayer reinforced composite electrolyte membrane, wherein the two ionomer layers are the same as each other.

2. The method for manufacturing a multilayer reinforced composite electrolyte membrane according to claim 1, wherein the multilayer reinforced composite electrolyte membrane comprises 2 to 9 layers of the reinforced composite electrolyte membranes.

3. The method for manufacturing a multilayer reinforced composite electrolyte membrane according to claim 1, wherein the ionomer is a perfluorosulfonic acid (PFSA) ionomer, and the porous support is polytetrafluoroethylene (PTFE).

4. The method for manufacturing a multilayer reinforced composite electrolyte membrane according to claim 1, wherein a thickness of the multilayer reinforced composite electrolyte membrane is 27-95 μm.

5. The method for manufacturing a multilayer reinforced composite electrolyte membrane according to claim 1, wherein a Young's modulus of the multilayer reinforced composite electrolyte membrane is 250-400 MPa.

6. The method for manufacturing a multilayer reinforced composite electrolyte membrane according to claim 1, wherein the multilayer reinforced composite electrolyte membrane has a dimensional change rate of 0.1-6% as defined by Equation 1:

$$\text{Dimensional change rate (\%)} = \frac{A_{wet} - A_{dry}}{A_{dry}} \quad \text{[Equation 1]}$$

Dimensional change rate wherein $A_{wet}$ means an area of the multilayer reinforced composite electrolyte membrane after being impregnated in ultrapure water for 24 hours at 25° C., and $A_{dry}$ means an area of the multilayer reinforced composite electrolyte membrane in a dry state.

7. The method for manufacturing a multilayer reinforced composite electrolyte membrane according to claim 1, wherein the multilayer reinforced composite electrolyte membrane comprises two layers of stacked reinforced composite electrolyte membrane, a thickness of the multilayer reinforced composite electrolyte membrane is 40-75 μm, a Young's modulus of the multilayer reinforced composite electrolyte membrane is 300-320 MPa, the multilayer reinforced composite electrolyte membrane has a dimensional change rate of 1-4.5% as defined by Equation 1:

$$\text{Dimensional change rate (\%)} = \frac{A_{wet} - A_{dry}}{A_{dry}} \quad \text{[Equation 1]}$$

Dimensional change rate where $A_{wet}$ means an area of the multilayer reinforced composite electrolyte membrane after being impregnated in ultrapure water for 24 hours at 25° C., and $A_{dry}$ means an area of the multilayer reinforced composite electrolyte membrane in a dry state.

* * * * *